US009493326B2

(12) United States Patent
Simmons et al.

(10) Patent No.: US 9,493,326 B2
(45) Date of Patent: Nov. 15, 2016

(54) CLASP-AND-LUG SYSTEM

(71) Applicant: ConXtech, Inc., Pleasanton, CA (US)

(72) Inventors: Maxwell C. Simmons, Hayward, CA (US); Robert J. Simmons, Hayward, CA (US)

(73) Assignee: ConXtech, Inc., Pleasanton, CA (US)

( * ) Notice: Subject to any disclaimer, the term of this patent is extended or adjusted under 35 U.S.C. 154(b) by 0 days.

(21) Appl. No.: 14/596,135

(22) Filed: Jan. 13, 2015

(65) Prior Publication Data

US 2015/0197411 A1 Jul. 16, 2015

Related U.S. Application Data

(60) Provisional application No. 61/926,815, filed on Jan. 13, 2014.

(51) Int. Cl.
*B66C 1/66* (2006.01)
*E04G 21/14* (2006.01)
*E04G 21/16* (2006.01)

(52) U.S. Cl.
CPC ..... *B66C 1/66* (2013.01); *E04G 21/142* (2013.01); *E04G 21/165* (2013.01)

(58) Field of Classification Search
CPC ..... B66C 1/66
USPC ..... 294/89, 90, 82.1, 82.11, 82.31; 52/125.2, 125.4, 125.5; 411/400
See application file for complete search history.

(56) References Cited

U.S. PATENT DOCUMENTS 835,059 A 11/1906 Curley
925,677 A 6/1909 Belcher
1,110,185 A 9/1914 Brown et al.
1,367,044 A 2/1921 Hausler
1,400,066 A 12/1921 Huck
1,471,094 A 10/1923 Bloss (Continued)

FOREIGN PATENT DOCUMENTS

DE 2758992 A1 7/1979
DE 102009050139 A1 4/2011

(Continued)

OTHER PUBLICATIONS

The U.S. Receiving Office of WIPO, International Search Report and Written Opinion of the International Searching Authority regarding PCT Application No. PCT/US2015/011270, which shares the same priority as this U.S. application, dated Apr. 6, 2015, 6 pages.

(Continued)

*Primary Examiner* — Paul T Chin
(74) *Attorney, Agent, or Firm* — Kolisch Hartwell, P.C.

(57) ABSTRACT

System, including methods and apparatus, for mechanically moving components with lifting machinery. In some embodiments, the system may comprise a lug mounted to a component, and a clasp. The clasp may include a body configured to receive the lug. The clasp also may include a gate mechanism configured to support the body when the clasp is supported by lifting machinery, and to move with respect to the body between (a) an open position that allows removal of the lug from the body when the gate mechanism is not supporting the body and (b) a closed position that prevents removal of the lug from the body when the gate mechanism is supporting the body.

20 Claims, 8 Drawing Sheets

(56) References Cited

U.S. PATENT DOCUMENTS

| | | | | |
|---|---|---|---|---|
| 1,729,743 | A | 10/1929 | Jorgensen et al. | |
| 2,008,087 | A | 7/1935 | Stromberg | |
| 2,569,653 | A | 10/1951 | Boedecker | |
| 2,673,700 | A | 3/1954 | Eberhardt | |
| 3,071,205 | A | 1/1963 | Beck, Jr. | |
| 3,148,477 | A | 9/1964 | Bjørn et al. | |
| 3,270,997 | A | 9/1966 | Gethmann | |
| 3,396,499 | A | 8/1968 | Biffani | |
| 3,401,739 | A | 9/1968 | Opletal | |
| 3,410,044 | A | 11/1968 | Moog | |
| 3,499,676 | A | 3/1970 | Haeussler | |
| 3,533,592 | A | 10/1970 | Jennings | |
| 3,562,988 | A | 2/1971 | Gregoire | |
| 3,664,011 | A | 5/1972 | Labastrou | |
| 3,685,866 | A | 8/1972 | Patenaude | |
| 3,706,169 | A | 12/1972 | Rensch | |
| 3,784,151 | A | 1/1974 | Steele | |
| 3,829,999 | A | 8/1974 | Bernstein | |
| 3,977,801 | A | 8/1976 | Murphy | |
| 4,019,298 | A | 4/1977 | Johnson, IV | |
| 4,058,339 | A * | 11/1977 | Burchard, Jr. | E21B 19/12 294/91 |
| 4,059,931 | A | 11/1977 | Mongan | |
| 4,079,983 | A * | 3/1978 | Van Mastrigt | B66C 1/66 294/89 |
| 4,173,367 | A * | 11/1979 | Haeussler | E04G 21/142 294/82.34 |
| 4,306,397 | A | 12/1981 | Ramseyer | |
| 4,360,230 | A * | 11/1982 | Wood | B66C 1/66 294/82.3 |
| 4,438,607 | A | 3/1984 | Nelson | |
| 4,522,001 | A | 6/1985 | Meyer | |
| 4,540,210 | A * | 9/1985 | Smith | B63B 21/60 114/252 |
| 4,577,449 | A | 3/1986 | Celli | |
| 4,671,554 | A * | 6/1987 | Lancelot | B66C 1/666 294/82.24 |
| 4,684,285 | A | 8/1987 | Cable | |
| 4,701,131 | A | 10/1987 | Hildebrandt et al. | |
| 4,736,554 | A | 4/1988 | Tyler | |
| 4,742,665 | A | 5/1988 | Baierl | |
| 4,754,712 | A | 7/1988 | Olson et al. | |
| 4,769,960 | A | 9/1988 | Zipf et al. | |
| 4,821,844 | A | 4/1989 | Huffman et al. | |
| 4,830,144 | A | 5/1989 | Werner | |
| 4,852,501 | A | 8/1989 | Olson et al. | |
| 4,905,436 | A | 3/1990 | Matsuo et al. | |
| 5,061,111 | A | 10/1991 | Hosokawa | |
| 5,240,089 | A | 8/1993 | Spera | |
| 5,244,300 | A | 9/1993 | Perreira et al. | |
| 5,289,665 | A | 3/1994 | Higgins | |
| 5,342,138 | A | 8/1994 | Saito et al. | |
| 5,590,974 | A | 1/1997 | Yang | |
| 5,605,410 | A | 2/1997 | Pantev | |
| 5,615,529 | A | 4/1997 | Johnson et al. | |
| 5,617,931 | A | 4/1997 | Zygmun et al. | |
| 5,678,375 | A | 10/1997 | Juola | |
| 6,082,070 | A | 7/2000 | Jen | |
| 6,092,347 | A | 7/2000 | Hou | |
| 6,106,186 | A | 8/2000 | Taipale et al. | |
| 6,219,989 | B1 | 4/2001 | Tumura | |
| 6,378,265 | B1 | 4/2002 | Konstandt | |
| 6,390,719 | B1 | 5/2002 | Chan | |
| 6,554,102 | B2 | 4/2003 | Schwörer | |
| 6,651,393 | B2 | 11/2003 | Don et al. | |
| 6,802,169 | B2 | 10/2004 | Simmons | |
| 6,837,016 | B2 | 1/2005 | Simmons et al. | |
| 6,913,422 | B2 | 7/2005 | Rogers | |
| 7,021,020 | B2 | 4/2006 | Simmons et al. | |
| 7,032,712 | B2 | 4/2006 | Schwörer | |
| 7,082,694 | B2 | 8/2006 | Lyman, Jr. | |
| 7,469,485 | B1 | 12/2008 | Perdue | |
| 7,470,081 | B2 | 12/2008 | Miyahara et al. | |
| 7,562,919 | B2 * | 7/2009 | Lawley | B66C 1/666 294/215 |
| D611,166 | S | 3/2010 | Hammer | |
| 7,677,522 | B2 | 3/2010 | Bakos | |
| 7,941,985 | B2 | 5/2011 | Simmons | |
| 8,011,150 | B2 | 9/2011 | Luttrell et al. | |
| 8,056,299 | B2 | 11/2011 | Liskey | |
| 8,132,774 | B1 | 3/2012 | Whatcott | |
| 8,136,460 | B2 | 3/2012 | Tait et al. | |
| 8,161,698 | B2 | 4/2012 | Migliore | |
| 8,161,707 | B2 | 4/2012 | Simmons | |
| 8,297,002 | B2 | 10/2012 | Fernández Fernández | |
| 8,297,887 | B2 | 10/2012 | Ness et al. | |
| 8,522,507 | B2 | 9/2013 | Asada et al. | |
| 8,528,298 | B2 | 9/2013 | Semaan et al. | |
| 8,627,615 | B2 | 1/2014 | Moyher | |
| 8,646,232 | B2 | 2/2014 | Liskey | |
| 2002/0043038 | A1 | 4/2002 | Cerrato | |
| 2003/0178253 | A1 | 9/2003 | Tatge et al. | |
| 2004/0237439 | A1 | 12/2004 | Powell | |
| 2005/0066612 | A1 | 3/2005 | Simmons | |
| 2007/0256391 | A1 | 11/2007 | Mifsud et al. | |
| 2008/0245023 | A1 | 10/2008 | Simmons | |
| 2009/0052980 | A1 | 2/2009 | Williams | |
| 2010/0316441 | A1 | 12/2010 | Vicentelli | |
| 2011/0031371 | A1 * | 2/2011 | Rube | B66C 1/66 248/499 |
| 2012/0110947 | A1 | 5/2012 | Simmons | |
| 2012/0160137 | A1 | 6/2012 | Linares | |
| 2012/0292131 | A1 | 11/2012 | Lovas | |
| 2013/0319796 | A1 | 12/2013 | Davis | |
| 2014/0183330 | A1 | 7/2014 | Simmons et al. | |
| 2014/0202795 | A1 | 7/2014 | Simmons et al. | |
| 2014/0208666 | A1 | 7/2014 | Simmons et al. | |

FOREIGN PATENT DOCUMENTS

| | | | |
|---|---|---|---|
| FR | 2471461 | A1 | 6/1981 |
| FR | 2613403 | A1 | 10/1988 |
| GB | 1204327 | A | 9/1970 |
| GB | 2261651 | A | 5/1993 |
| JP | 11-22001 | A | 1/1999 |
| JP | 2000-110236 | A | 4/2000 |
| WO | 9836134 | A1 | 8/1998 |
| WO | 2011047830 | A1 | 4/2011 |

OTHER PUBLICATIONS

Conxtech. 'ConX Modular Pipe Rack' [online]. Jan. 6, 2013. Retrieved from the internet: <http://www.conxtech.com/conx-system/conx-modular-pipe-rack/>; p. 1, figure 1, paragraphs 1, 2; p. 2, paragraph 1, 3 pages.

Conxtech Brochure. 'CONX Modular Pipe Rack' [online]. Apr. 16, 2014. Retrieved from the internet: <http://www.conxtech.com_wp-content_uploads_files_documents_ConX_Modular_Pipe_Rack_Brochure.pdf>; 25 pages.

The U.S. Receiving Office of WIPO, International Search Report and Written Opinion of the International Searching Authority regarding PCT Application No. PCT/US2014/013014, dated May 14, 2014, 6 pages.

U.S. Patent and Trademark Office, Office action regarding U.S. Appl. No. 14/163,778, dated Oct. 1, 2014, 16 pages.

U.S. Patent and Trademark Office, Office action regarding U.S. Appl. No. 14/163,778, dated Jan. 26, 2015, 16 pages.

The International Bureau of WIPO, International Preliminary Report on Patentability regarding PCT Application No. PCT/US2015/011270, which shares the same priority as this U.S. application, dated Jul. 19, 2016, 5 pages.

* cited by examiner

No Tension

No Tension

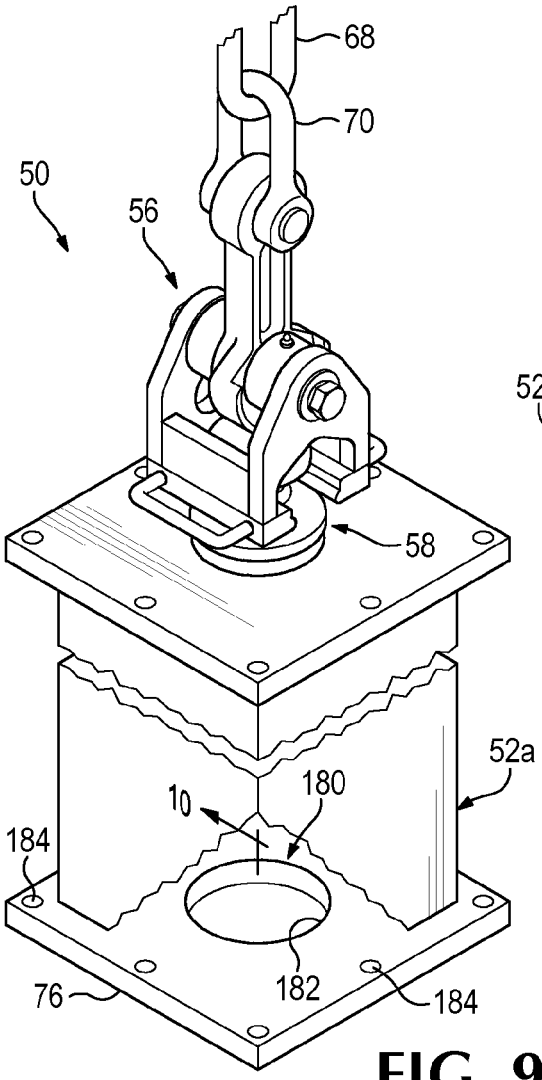
FIG. 9
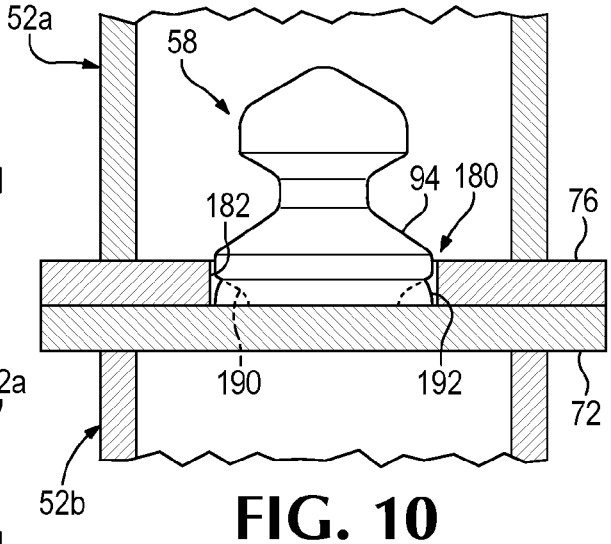
FIG. 10
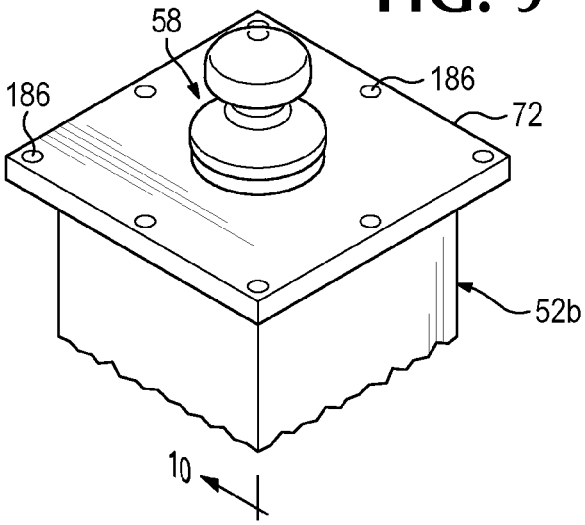

CLASP-AND-LUG SYSTEM

CROSS-REFERENCE TO PRIORITY APPLICATION

This application is based upon and claims the benefit under 35 U.S.C. §119(e) of U.S. Provisional Patent Application Ser. No. 61/926,815, filed Jan. 13, 2014, which is incorporated herein by reference in its entirety for all purposes.

CROSS-REFERENCE TO OTHER MATERIAL

This application incorporates herein by reference the following patent document in its entirety for all purposes: U.S. Patent Application Publication No. US 2014/0208666 A1, published Jul. 31, 2014.

INTRODUCTION

Large frameworks formed of vertical columns and horizontal beams are often present at construction sites. These frameworks, often formed of metal such as steel, may, for example, provide the internal support of a building or can function as open supports in the absence of added walls, such as to support and elevate lengths of pipe or other structures.

A framework can be constructed at least in part by picking and moving individual structural frame components into position on a growing framework and attaching each component in place. For example, each component can be connected to a crane by a worker on the ground, moved into position by operation of the crane, and then held by the crane as the component is being attached. However, safely and reliably connecting each component to the crane and then disconnecting the component from the crane after placement can be time-consuming. Accordingly, improved approaches are needed for moving components, such as structural frame components at a construction site.

SUMMARY

The present disclosure provides a system, including methods and apparatus, for mechanically moving components with lifting machinery. In some embodiments, the system may comprise a lug mounted to a component, and a clasp. The clasp may include a body configured to receive the lug. The clasp also may include a gate mechanism configured to support the body when the clasp is supported by lifting machinery and to move with respect to the body between (a) an open position that allows removal of the lug from the body when the gate mechanism is not supporting the body and (b) a closed position that prevents removal of the lug from the body when the gate mechanism is supporting the body.

BRIEF DESCRIPTION OF THE DRAWINGS

FIG. 9 is a fragmentary isometric view of the clasp-and-lug system of FIG. 1 being used to place the column of FIG. 1 onto another column, such that a receiver at a lower end of an overlying column receives a lug anchored at an upper end of an underlying column, in accordance with aspects of the present disclosure.

FIG. 10 is a fragmentary, partially sectional view of the system of FIG. 9, taken generally along line 10-10 of FIG. 9 after placement of the lug into the receiver at the lower end of the overlying column.

DETAILED DESCRIPTION

Figure 1:
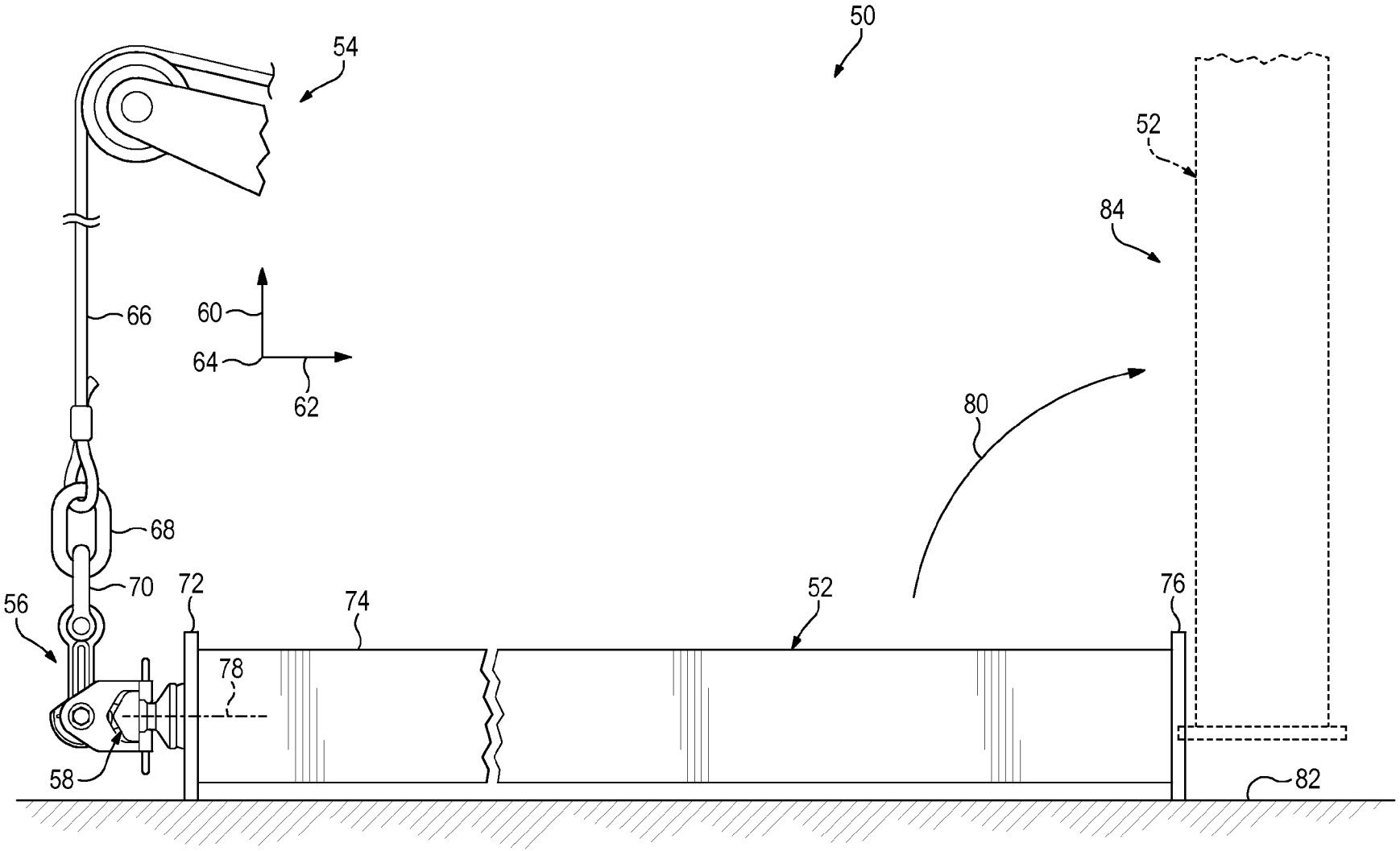
FIG. 1 is a fragmentary view of an exemplary clasp-and-lug system for mechanically handling components, such as structural frame components during construction of a framework, and showing a column arranged horizontally and connected to lifting machinery via a clasp mated with a lug, in accordance with aspects of the present disclosure.

The present disclosure provides a system, including methods and apparatus, for mechanically moving components with lifting machinery. In some embodiments, the system may comprise a lug mounted to a component, and a clasp. The clasp may include a body configured to receive the lug. The clasp also may include a gate mechanism configured to support the body when the clasp is supported by lifting machinery and to move with respect to the body between (a) an open position that allows removal of the lug from the body when the gate mechanism is not supporting the body and (b) a closed position that prevents removal of the lug from the body when the gate mechanism is supporting the body.

The present disclosure provides a system pertaining to the field of mechanical picking and moving. In some embodiments, the system meets a need in the art to be able easily to secure a bulb-shaped capture-profile lug, with the use of applied tension, and to be further able to release the lug once the lug is moved to a desired position by removing the applied tension. In some embodiments, the lug may be mated with a receiver that provides alignment and/or mounting, among others.

A clasp of the system may include (1) a lug-receiving structure and (2) a lifting machinery-attachable lug-capturing mechanism. The lug-receiving structure and the lug-capturing mechanism are operatively connected such that the lug-capturing mechanism is able to move, such as to rotate, relative to the lug-receiving structure. Once a user-selected lug is received by the lug-receiving structure, force (tension and/or torque) is applied to the lug-capturing mechanism via lifting machinery to capture, such as to secure and/or lock, the lug in place. With the lug captured, the user is able to operate the attached lifting machinery to lift and move the lug and any component to which the lug is attached, for example, to a vertical position, if the lug began in a horizontal position.

In some embodiments, the lug-receiving structure has an entry side, which is shaped to accept a bulb-shaped lug. The lug-receiving structure has a receiving area bounded by a lip or shelf that projects inward toward the center of the receiving area. The lip or shelf is able to support an upper part of the lug, at a region where the lug is smaller in diameter. Therefore, the lip or shelf is able to hold the bulb-shaped lug. The receiving area possesses entry and inner ends, and between those ends, the receiving area forms a seating region that is in the shape of a portion of the lug. This seating region, if held such that the receiving area is parallel to the ground, may prevent any lateral movement of the lug.

The machinery-attachable lug-securing mechanism may include a rotatable lever, which may be described as a tension-operated lever. The lever may have two ends, each rounded with a circle-shaped hole at each end. One end of the lever may be attached to the lug-receiving structure by inserting a shaft through a hole of the lever, and securing the lever with a series of washers and spacers, such that, once attached, the lever can rotate about an axis that extends in the same direction as the lug-receiving area. The lever, depending on its angle with respect to the lug-receiving structure, as determined by the force (or lack thereof) applied to the lever, is able either to secure the lug in place, or allow the lug to slide out of the lug-receiving structure.

The end of the lever that is attached to the lug-receiving structure of the clasp may have a rounded structure with different radius lengths. When tension is applied, the lever is oriented such that a larger radius length of the lever blocks movement of the lug toward the entry side of the lug-receiving structure. Conversely, if tension is released, the lever is reoriented such that a smaller radius length of the end of the lever allows the lug to be moved to the entry side of the lug-receiving structure for removal from the clasp.

The system of the present disclosure may be especially suited for picking and maneuvering, from horizontal to vertical dispositions, elongate structural columns.

FIG. 1 shows an exemplary clasp-and-lug system 50 for mechanically handling components, such as structural frame components during construction of a framework (also called a frame) that includes one or more of the frame components. Here, the structural frame component is a column 52 that will be arranged vertically in the constructed framework. In other embodiments, the structural frame component may be any other structural component of a prospective framework, such as a ground support or pedestal, a beam, a truss, a pre-constructed assembly of two or more structural frame components (e.g., including two or more columns), or a full frame, among others. However, the clasp disclosed herein may be particularly suited for mechanically handling individual components (such as columns) when "stick building," namely, constructing a framework in a piece-by-piece manner. A structural frame component may or may not be incorporated into a framework that ultimately will form the internal support for a building having walls.

More generally, system 50 may be suitable for picking, moving, aligning, and/or mounting one or more components of any suitable type or structure. Exemplary components that may be handled mechanically by system 50 include structural frame components (as described above), accessories, storage containers, vehicles (e.g., a truck, a car, etc.), an aircraft, a watercraft, or the like.

Column 52 is connected to lifting machinery 54 of system 50 via a clasp 56 connected to a lug 58 (which may include a knob and/or may be bulb-shaped). The lifting machinery may include any suitable apparatus for raising and lowering clasp 56, lug 58, and a connected component(s) (such as column 52). Besides raising and lowering the component, the lifting machinery also may be capable of moving the connected component horizontally. Accordingly, the lifting machinery may provide positioning of the component with respect to three mutually orthogonal axes 60, 62, and 64 (i.e., to change the elevation of the component and its position along the ground). Lifting machinery 54 may include an elongate, flexible supporting element, such as a cable 66, a chain, a rope, or a combination thereof, which may be selectively tensioned as needed. The lifting machinery also may include one or more links 68, 70 that connect cable 66 (or another supporting element) to clasp 56. The lifting machinery further may include at least one motor to move and apply tension to the cable (or other supporting element) and/or to generate a supporting/lifting force (tension and/or torque) to be applied to the clasp. Exemplary lifting machinery includes a crane, a fork lift, or the like.

Lug 58 may be anchored to an end of column 52, such as a prospective upper end of the column. For example, lug 58 may be welded to a cap plate 72, which may be welded or otherwise mounted to an upper end of a shaft 74 of the column. A base plate 76 may be welded or otherwise mounted to a prospective lower end of shaft 74. Shaft 74 may be solid, hollow, or filled (such as with concrete, among others).

Lug 58 may define a central axis 78, which may be arranged substantially parallel and/or coaxially to a long axis and/or a central axis of column 52 (and/or other component). The lug may have rotational symmetry about central axis 78 and/or reflectional symmetry with respect to a plane containing the central axis. Further aspects of exemplary lugs that may be suitable are described in U.S. Patent Application Publication No. US 2014/0208666 A1, published Jul. 31, 2014, which is incorporated herein by reference.

Clasp 56 and lug 58 may be mated with one another (e.g., by moving the clasp while the lug remains stationary, or vice versa) when central axis 78 and column 52 are each at least generally horizontal, as shown. Lifting machinery 54 may be operated to lift column 52, indicated by an arrow 80, from an at least generally horizontal orientation, such as resting on ground 82, to an upright orientation (shown in phantom at 84). The lifting machinery also may be operated to lower the lifted column (or other overlying component) onto an underlying component, such as onto a copy of the lug anchored to the underlying component (see below).

Figure 2:
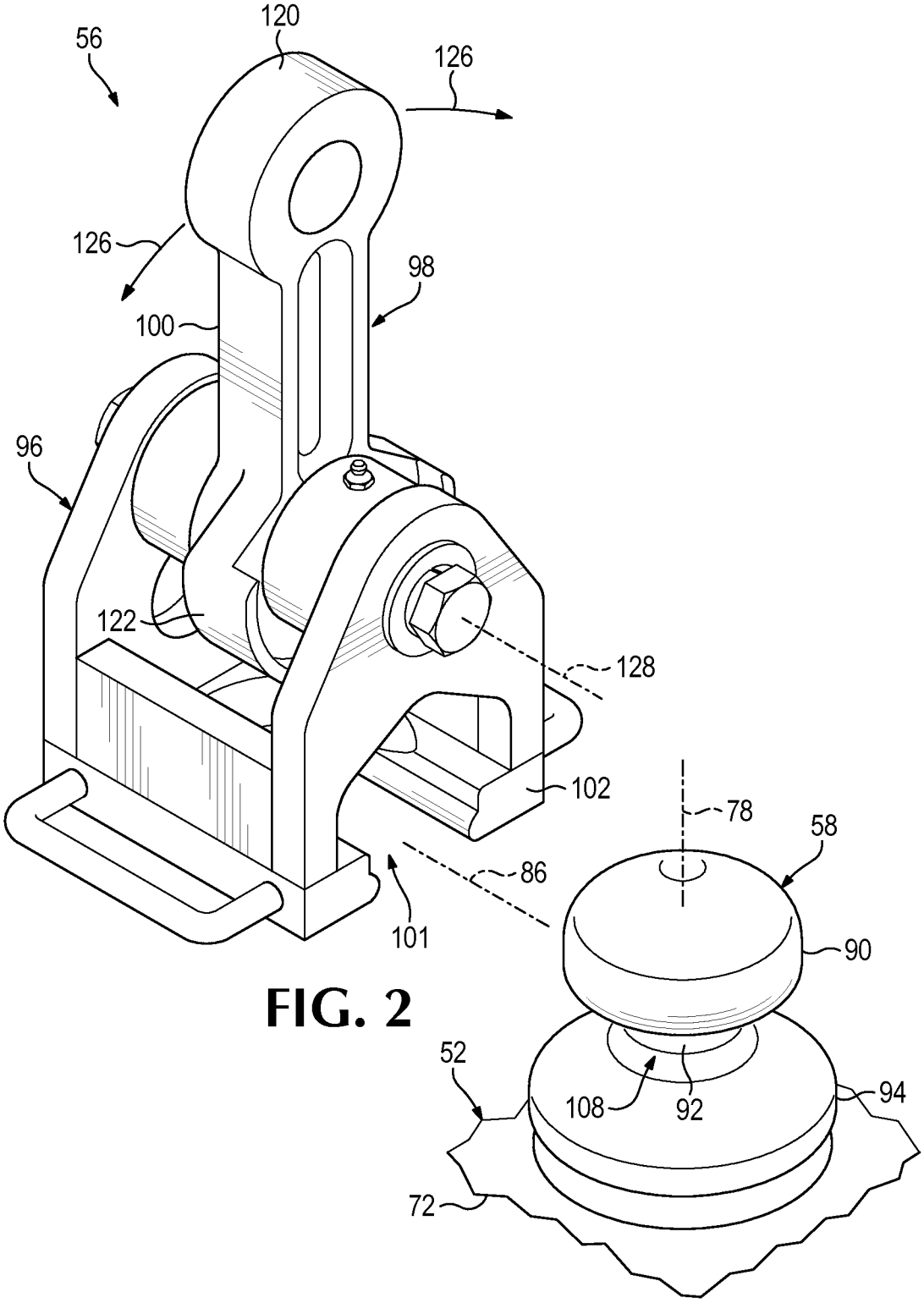
FIG. 2 is an isometric view of the clasp and the lug of FIG. 1 arranged to be mated with one another by transverse motion of the clasp and lug relative to one another.

FIG. 2 shows clasp 56 and lug 58 positioned to be mated with one another by transverse motion of the clasp and lug relative to one another along a mating axis 86 (also called a receiving axis). The mating axis is transverse to central axis 78, and may or may not be substantially orthogonal to central axis 78.

Lug 58 may vary in diameter along central axis 78 to form a head 90, a neck 92, and a base 94. The head and base each may have a larger maximum diameter than neck 92, such that neck 92 is a waist. Also, the maximum diameter of the head may be less than (or greater than) the maximum diameter of the base. In some embodiments, base 94 may be omitted from the lug.

Head 90, neck 92, and base 94 each may have any suitable shape. Head 90 may be spherical, conical, cylindrical, or paraboloid, among others. Accordingly, the head may or may not taper along central axis 78 in a direction away from and/or toward the attached component (such as column 52). Neck 92 may have a diameter that is uniform or that varies along central axis 78. If the diameter of the neck varies, the neck may, for example, taper convergently from head 90 and base 94 to form a concave profile.

Clasp 56 includes a body 96 (also called a lug-receiving structure) and a gate mechanism 98, such as a lever 100, movably connected to the body. Body 96 may form a receiving space or void 101 to receive at least a portion of the lug, such as head 90 and at least an upper portion of neck 92, when the lug is side-loaded into the clasp (i.e., introduced into the clasp by relative motion of the clasp and lug along mating axis 86).

Figure 3:
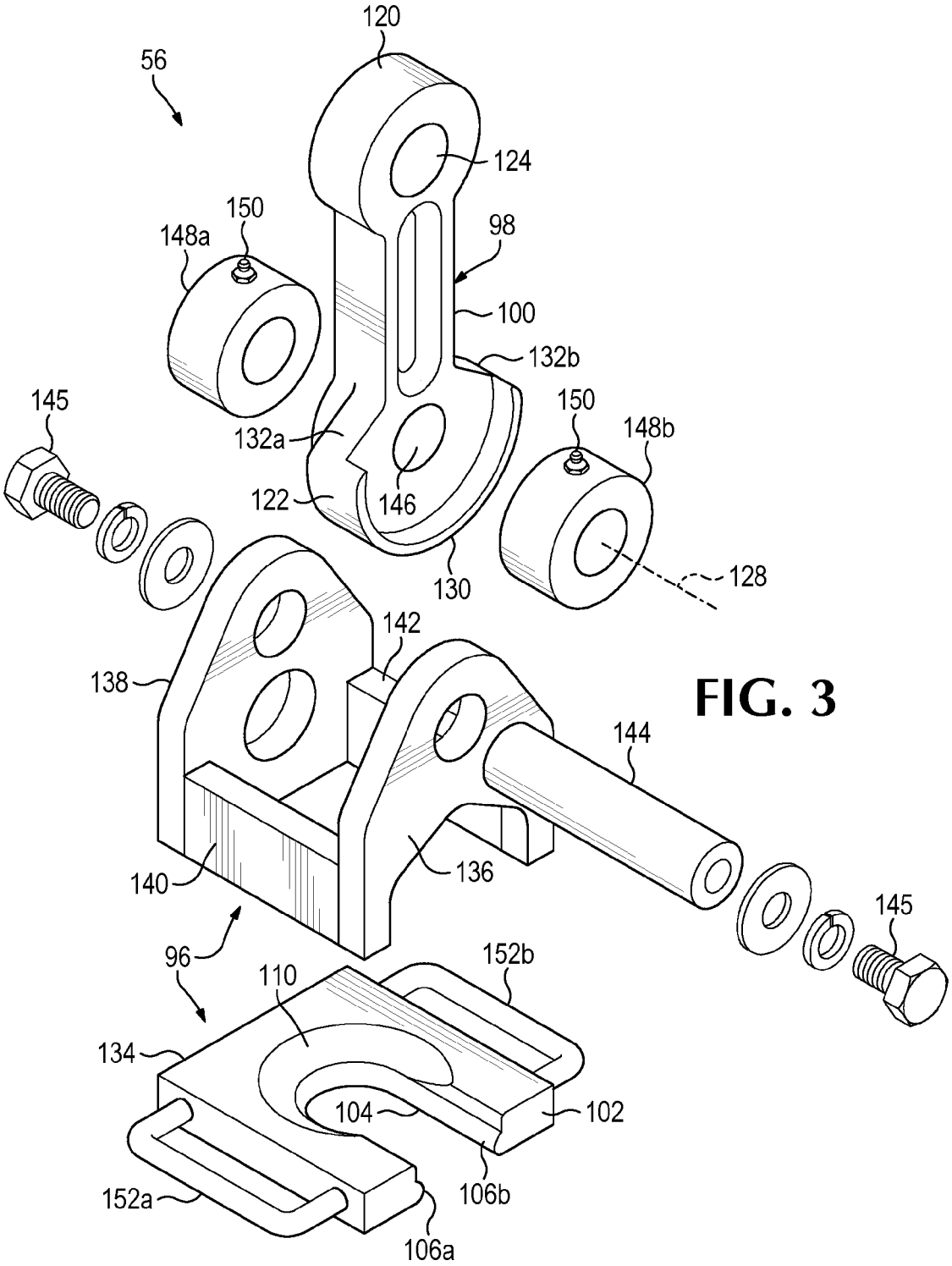
FIG. 3 is an exploded isometric view of the clasp of FIG. 2.

Body 96 may include a bracket or shelf 102 defining an opening 104 (also see FIG. 3). The opening may have an entry end opposite an inner end. Lug 58 (such as neck 92 thereof) may enter opening 104 at the entry end and may be advanced to a position near the inner end. Lips 106*a*, 106*b* of bracket 102 may be received in an annular concavity 108 (see FIG. 2) defined by lug 58 around neck 92, to restrict axial motion of the lug (i.e., motion parallel to central axis 78), thus preventing axial removal of the lug from the clasp by motion of the clasp and lug relative to one another parallel to central axis 78.

Bracket 102 may define a recessed seating region 110 near the inner end of opening 104, on a top side of the bracket. The recessed seating region may be spaced from the entry end and may be complementary to a lower portion (an underside) of head 90 of the lug. Accordingly, the lug may be displaced axially (away from the top of the clasp in FIG. 2) as it enters seating region 110, to achieve contact with the seating region. In other words, mating of the lug with the clasp may involve displacement of the clasp and lug relative to one another along mating axis 86 and, optionally, displacement along central axis 78.

Gate mechanism 98 may provide a linkage between lifting machinery 54 and body 96 of the clasp. In other words, the gate mechanism (and/or lever 100) may support body 96, lug 58, and column 52 at least partially during movement of the column 52 by the lifting machinery. Accordingly, the gate mechanism may have opposite end regions 120 and 122, with end region 120 connected to the lifting machinery and end region 122 movably connected to body 96 (see FIGS. 2 and 3). In some embodiments, end region 120 may define a hole 124 to receive a link, such as link 70 (also see FIG. 1).

Gate mechanism 98 may be configured to move, indicated by motion arrows at 126 in FIG. 2, between a lug-capturing position (also called a "closed" position) and a lug-releasing position (also called an "open" position), in response to application and removal of upward force (torque and/or tension) on the gate mechanism. More particularly, the gate mechanism moves to a capturing or closed position when the lifting machinery applies an upward force on the gate mechanism and moves to a releasing or open position when the upward force is removed. The gate mechanism may be provided by lever 100, which is rotatable with respect to body 96 about a pivot axis 128 to move between one or more open positions and one or more closed positions. Pivot axis 128 may be substantially parallel to mating axis 86. In other embodiments, the gate mechanism may move translationally between open and closed positions.

Lever 100 may have a varying radius at end region 122, as measured from pivot axis 128 (see FIG. 3). In the depicted embodiment, the lever has a circular region 130 (also called a capturing region or obstructing region) having a larger radius, and a pair of narrowed regions 132*a* and 132*b* (also called releasing regions) where the radius is decreased relative to circular region 130. Alignment of any part of circular region 130 with lug 58 produces a closed position of the lever, which obstructs removal of the lug from the clasp. Alignment of either narrowed region 132*a* or 132*b* with the lug produces an open position of the lever, which permits removal of the lug from the clasp. Accordingly, the angular position of the lever with respect to body 96 determines whether the lever is in a closed position or an open position and whether or not the lever obstructs removal of the lug from the clasp. Each closed position of the lever also obstructs placement of lug 58 into the recessed seating region of the clasp, from a position outside the clasp. Therefore, lever 100 must rotate to an open position from the closed position of FIG. 2, before the lug can be mated with and seated in the clasp.

FIGS. 2 and 3 show further aspects of the clasp. Body 96 may be formed by a base 134 (forming bracket 102), a front member 136, a back member 138, and a pair of side members 140 and 142, which may be attached to one another by welding, fasteners, or the like. Lower end region 122 of lever 100 may be pivotably mounted on a shaft or axle 144 that is attached to front member 136 and back member 138 with fasteners 145 and associated washers. Lower end region 122 of lever 100 may define a through-hole 146 to receive shaft 144. A pair of collars 148*a*, 148*b* also may be disposed around shaft 144, to serve as spacers between lever 100 and front member 136 and back member 138. Each collar may include a nipple 150 at which a lubricant can be introduced to facilitate motion of the moving parts of the clasp relative to one another.

One or more handles 152*a*, 152*b* may be mounted on body 96, to allow a user (e.g., a worker on the ground that mates the clasp and the lug with one another) to grasp and manipulate the clasp. In the depicted embodiment, the handles are mounted to opposite edges of base 134, with opening 104 located between the handles.

FIGS. 4-7 show a sequence of exemplary configurations of the clasp-and-lug system of FIG. 1 produced during performance of an exemplary method of mechanically handling a component (e.g., column 52). Column 52 is oriented horizontally in FIGS. 4 and 5, and is oriented vertically in FIGS. 6 and 7 after lifting the column from the horizontal orientation of FIGS. 4 and 5.

Figure 4:
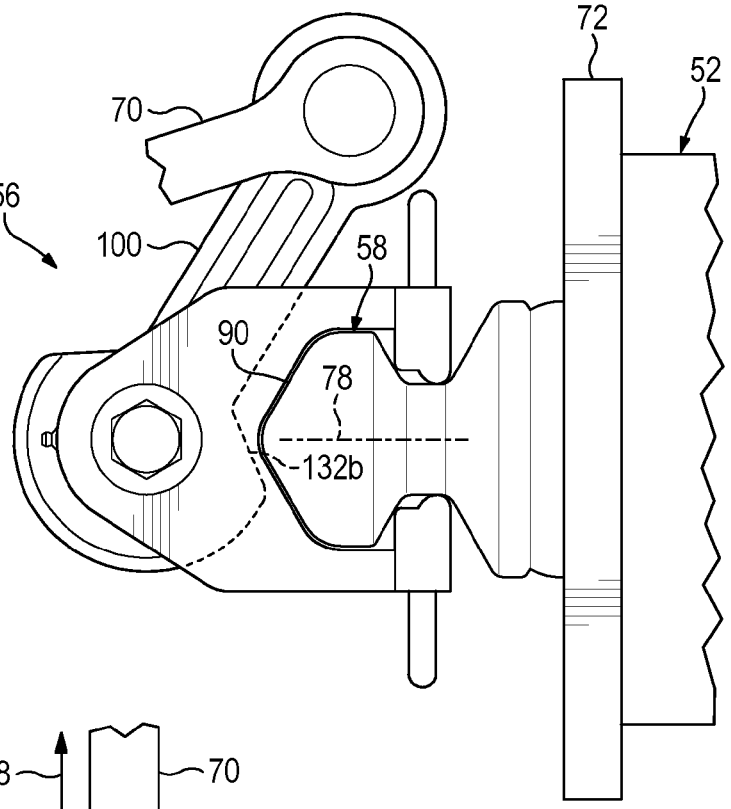
FIGS. 4-7 are fragmentary side views of a sequence of exemplary configurations of the clasp-and-lug system of FIG. 1 produced (a) upon mating the clasp and lug with one another while the column is horizontal and before a lifting force is applied to a gate mechanism of the clasp (FIG. 4), (b) as a lifting force is applied to the gate mechanism of the clasp with lifting machinery such that the gate mechanism is moved to a lug-capturing position before lifting begins (FIG. 5), (c) with the column lifted to an upright (vertical) orientation and with tension still applied to the gate mechanism with the lifting machinery such that the gate mechanism remains in a lug-capturing position (FIG. 6), and (d) with the column upright after release of tension on the gate mechanism of the clasp such that gravity causes the gate mechanism to return to a lug-releasing position (FIG. 7).
Figures 6, 7:
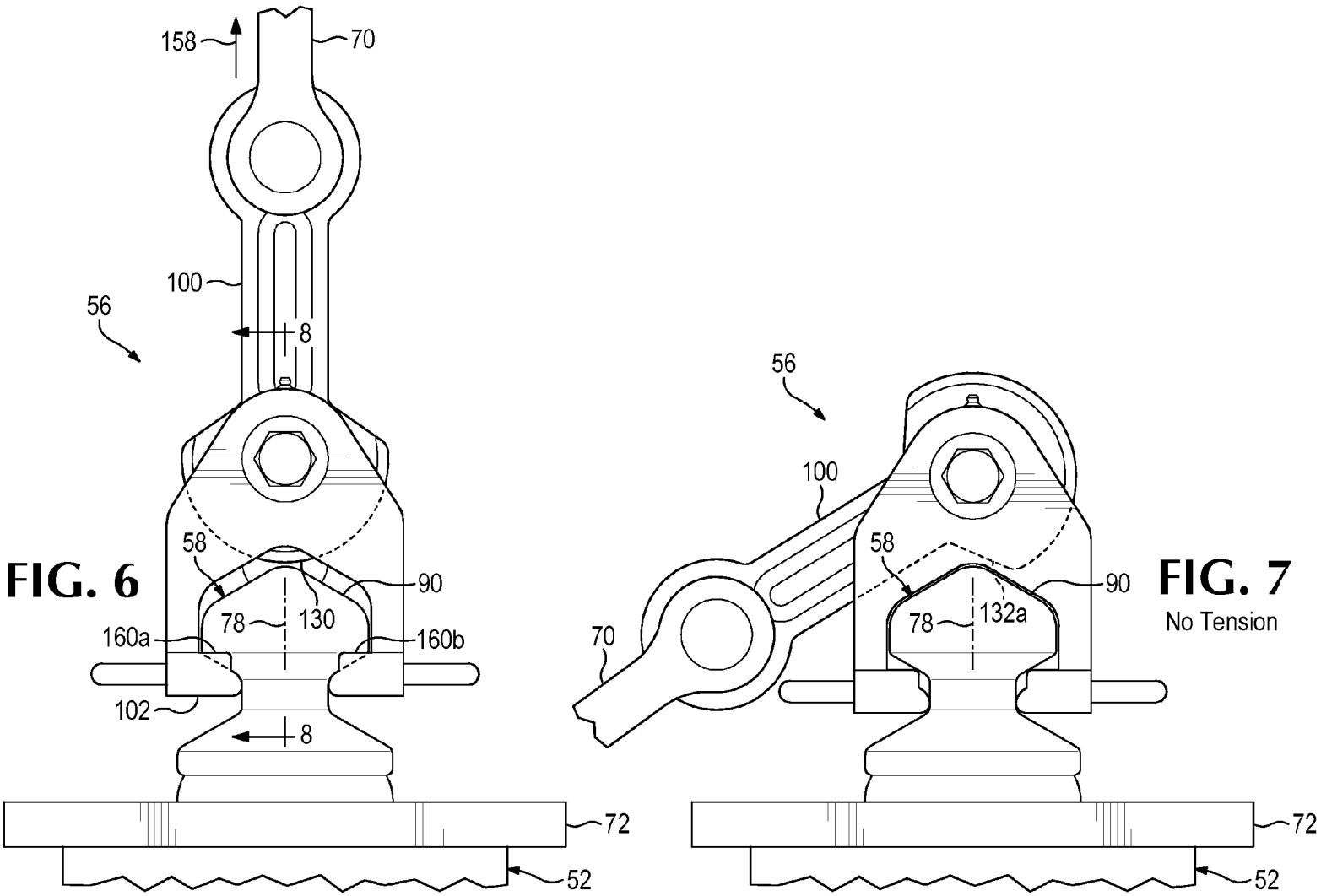

No upward force is being applied to lever 100 of the clasp with lifting machinery in FIGS. 4 and 7. Accordingly, the lever is not under tension and is not upright in FIGS. 4 and 7, but instead is in an open position, with narrowed region 132*a* or 132*b* aligned with central axis 78 of the lug. In each of these open positions, the lever is oriented to allow the received lug to be removed from the clasp. In other words, the lug is not secured or locked in the clasp. Also, the underside of head 90 of the lug is spaced axially (parallel to central axis 78) from recessed seating region 110 of the clasp (also see FIG. 3), and can slide out of the clasp along the mating axis (i.e., parallel to the viewing direction of FIGS. 4 and 7 for the depicted embodiment). The lever is in an open position when the clasp is being mated with the lug (to allow the lug to be received properly by the clasp) and after mechanical handling of the component is complete (to allow removal of the lug from the clasp). An open position of the lever may be produced automatically when gravity becomes dominant (e.g., when the lifting machinery is no longer applying tension to lever 100 and/or is no longer supporting lever 100, the body of clasp 58, and the component).

Figure 5:
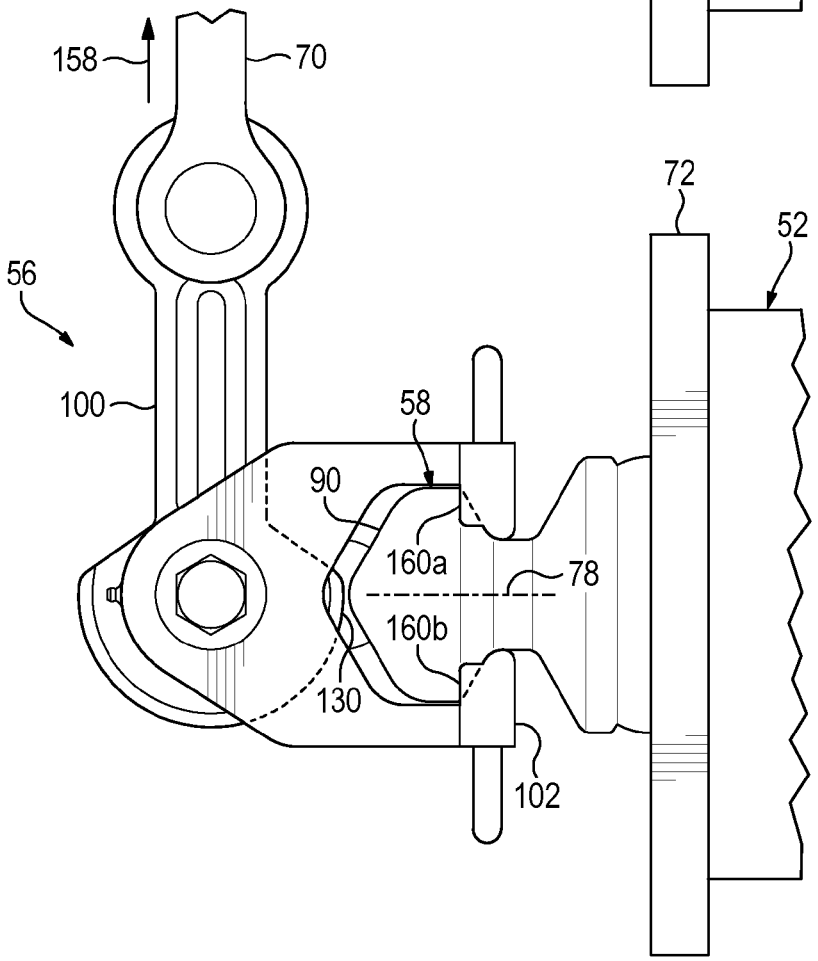

An upward force is being applied to lever 100 as tension with the lifting machinery in FIGS. 5 and 6, indicated by a tension arrow 158. This tension causes the lever to be upright whether the body of the clasp is oriented horizontally (FIG. 5) or vertically (FIG. 6). In each of FIGS. 5 and 6, the lever is in a closed position that aligns a distinct part of circular region 130 with central axis 78 of the lug. Central axis 78 is horizontal in FIG. 5 and vertical in FIG. 6. Thus, lever 100 may have at least two or at least three closed positions that are rotationally offset from one another by about one-fourth turn of the lever (90 degrees) and/or may have a pair of closed positions that are rotationally offset from one another by about one-half turn of the lever (180 degrees). A circular region and/or a lug-capturing region of the lever may extend about the rotation axis of the lever for at least about 90 degrees, such that the lever can remain in a closed position as the component is lifted from a horizontal orientation to a vertical orientation. Also, a circular region and/or a lug-capturing region of the lever may extend about the rotation axis of the lever for at least about 180 degrees, such that the lever can remain closed when rotated for at least about 90 degrees in opposite rotational directions from a rotationally central closed position. Furthermore, the lever may have a pair of open positions that are separated from one another by at least one closed position (and/or a set of closed positions spanning at least about one-fourth or one-half turn of the lever). The pair of open positions may be separated from one another by more than one-half turn of the lever. A clasp designed to have a pair of open positions allows the lever to fall in either opposite rotational direction to an open position when tension on the lever is released, and also allows the clasp to be operatively connected to a horizontally-oriented lug from opposite lateral sides of the lug.

Removal of head 90 of lug 58 from the clasp is obstructed in FIGS. 5 and 6 by a wall of recessed seating region 110 and by non-recessed sections 160*a*, 160*b* of bracket 102 that separate seating region 110 from the entry end of opening 104 (also see FIG. 3). Head 90 must be displaced axially (i.e., parallel to central axis 78) to clear this wall and these non-recessed regions in the depicted embodiment, when the lug is removed from the clasp. However, circular region 130 of lever 100 blocks the extent of axial displacement of the head needed to permit lug removal, such that head 90 cannot be removed from the clasp unless and until lever 100 moves to an open position (as in FIG. 7).

Figure 8:
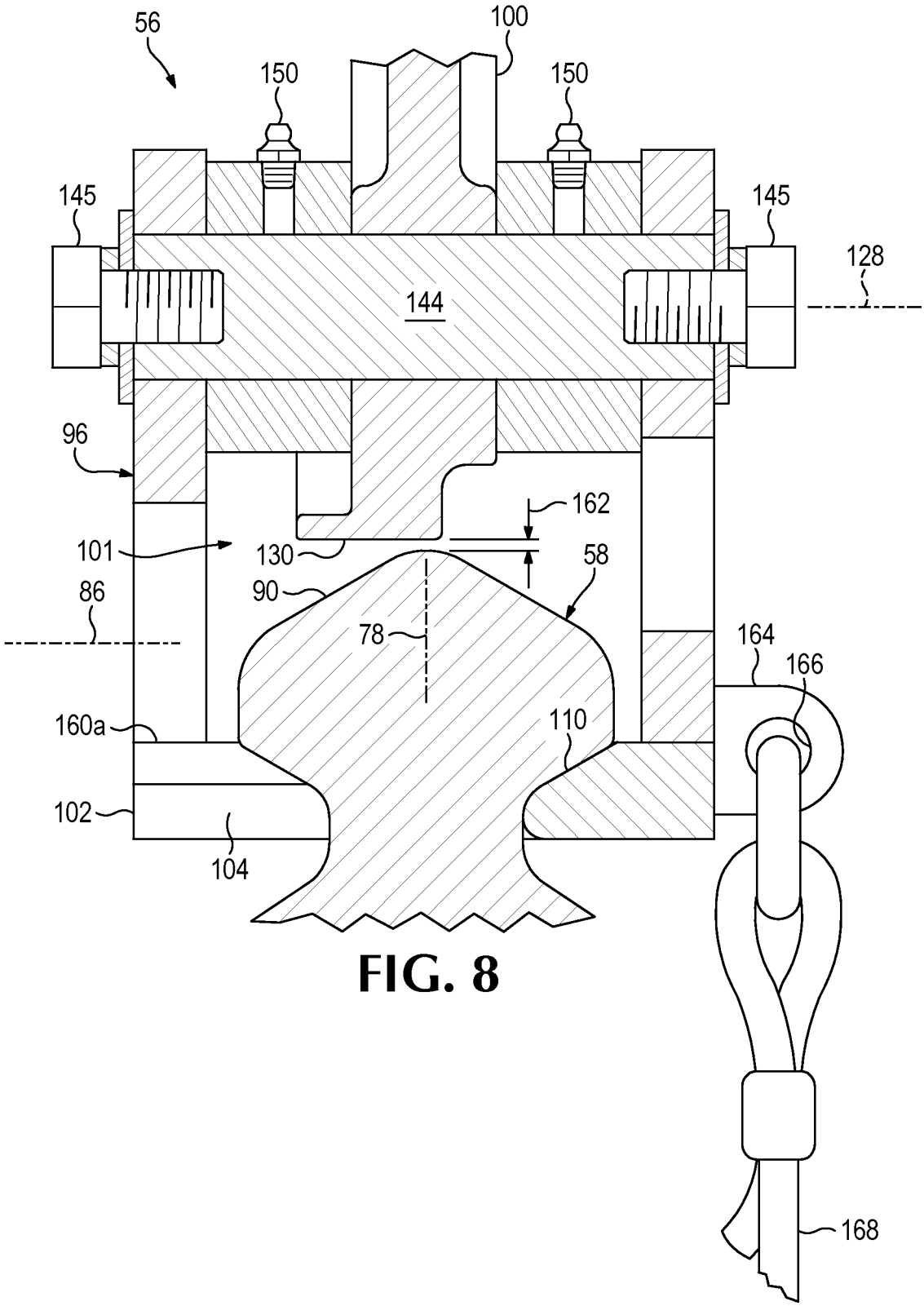
FIG. 8 is a fragmentary sectional view of the clasp and lug of FIG. 6, taken generally along line 8-8 of FIG. 6.

FIG. 8 shows a sectional view of the clasp and lug with lever 100 in the closed position of FIG. 6. The obstructing portion (region 130) of the lever may be in contact with the top end of lug 58 or, as shown, may be spaced slightly from the top end of the lug in the closed position to form a gap 162. However, gap 162 does not permit sufficient axial displacement of the lug to clear non-recessed section 160*a* of the bracket. In any event, each closed position of the lever may permit less axial motion of the lug (parallel to central axis 78) than each open position of the lever. In other embodiments, the obstructing portion of lever 100 may be aligned with the lug on mating axis 86 instead of on central axis 78, such that the obstructing portion contacts head 90 below the top end thereof to prevent removal of the lug from the clasp.

FIG. 8 also shows a tab 164 that projects from a back side of body 96 of the clasp. The tab defines an opening 166 to receive an attachment structure for a tether 168, which may be downwardly-extending. The tether may be pulled at least partially horizontally by a worker, after tension on lever 100 has been released, to apply a horizontal force to the clasp that removes the lug from the clasp (e.g., by movement of the clasp while the lug removes stationary). Accordingly, the worker can disconnect the clasp and the lug from each other remotely via tether 168, such as when the worker is located below the lug and clasp (e.g., when the worker is on the ground or an elevated platform).

FIGS. 9 and 10 show clasp-and-lug system 50 of FIG. 1 before (FIG. 9) and after (FIG. 10) placement of an overlying column 52*a* onto an underlying column 52*b*. The lower end of column 52*a* defines a receiver 180 (e.g., an opening) to receive lug 58 anchored at the top end of column 52*b*. Receiver 180 may, for example, be a through-hole 182 or a blind hole defined at least in part by base plate 76. The receiver and lug cooperate to axially align the columns, which may allow a worker to create alignment between base plate holes 184 and corresponding cap plate holes 186 (e.g., by rotating column 52*a* about its long axis, if needed) and to place fasteners into aligned pairs of holes 184 and 186, to attach the columns to one another.

The bottom end portion of lug 58 may taper downward from a maximum diameter of lug base 94 (see FIG. 10) to form an undercut region 190. A welding filler material 192 may be introduced into the undercut region when the lug is welded to the cap plate.

Figure 11:
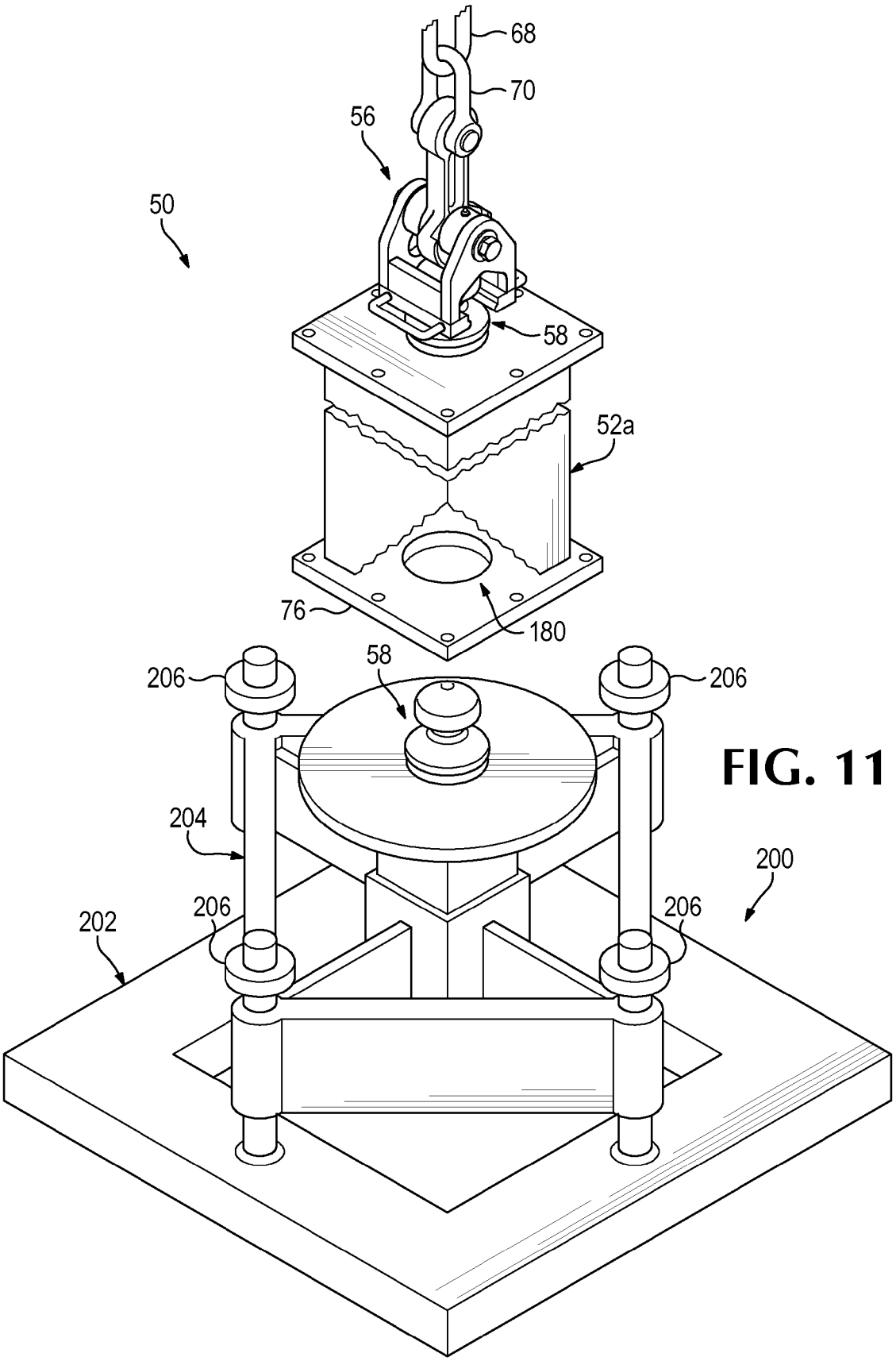
FIG. 11 is a fragmentary isometric view of the clasp-and-lug system of FIG. 1 being used to place the column of FIG. 1 onto a ground-supported pedestal, such that a receiver at a lower end of the column receives a lug anchored at an upper end of the pedestal, in accordance with aspects of the present disclosure.

FIG. 11 shows clasp-and-lug system 50 of FIG. 1 being used to place overlying column 52*a* of FIG. 9 onto a ground-supported pedestal 200 carrying a vertically-oriented lug 58, which is mounted to a plate of the pedestal. Pedestal 200, also described as a ground assembly, may allow lug 58 to be adjustably positioned and oriented with respect to three mutually orthogonal axes (e.g., adjustable translationally and rotationally with respect to each of the axes). For example, the entire pedestal may be moved along the ground or rotated about a vertical axis. Also, or in addition, the pedestal may have a lower support assembly 202 forming a base and supporting an upper support assembly 204. Assemblies 202 and 204 may be adjustably spaced from one another in a vertical direction via a set of leveling mechanisms 206, to adjust the verticality of the lug.

More generally, the clasp-and-lug system disclosed herein may be used to stack, align, and mount one component on another component. A prospective overlying component may have a first lug and a receiver corresponding to the first lug (e.g., configured to receive a copy of the first lug), with the first lug and the receiver arranged opposite one another, such as at prospective upper and lower regions (such as on the top and the bottom ends/sides) of the overlying component. The first lug may be mated with the clasp, as described above, and then lifting machinery may be operated to move the overlying component, to place the receiver of the overlying component above and in general vertical alignment with a second lug, which is mounted to an upper region (such as the top end/side) of a prospective underlying component. The lifting machinery may be operated further to lower the overlying component onto the underlying component, such that the second lug mounted to the underlying component is received by the receiver of the overlying component. As the copy of the lug is received, interaction between the second lug and the receiver may axially align the components with one another, which may center the overlying component on the underlying component. The components then may be attached to one another, such as with fasteners, by welding, with an adhesive, by bonding, or the like.

Further aspects of components, lifting machinery, framework configurations, lugs, clasps, ground assemblies, and use of a lug and a corresponding receiver for stacking and alignment, among others, that may be suitable for the clasp-and-lug system of the present disclosure are described in U.S. Patent Application Publication No. US 2014/0208666 A1, published Jul. 31, 2014, which is incorporated herein by reference.

Selected embodiments of the present disclosure are described in the following three paragraphs.

The present disclosure provides a mechanical picking system, which is operable to grasp a bulb-shaped lug, and further to safely secure the lug in such a way that it may be lifted to another location. The system may include (1) a lug-receiving structure, and (2) a machine or cable-attachable, lug-securing mechanism, that is attached to the lug-receiving structure in a manner that provides for relative motion between the lug-receiving structure and the lug-securing mechanism, secures the lug when tension is applied to the lug-securing mechanism, and releases when tension is removed.

The present disclosure also provides a system, and associated methodology for using, receiving, and reversibly holding a bulb-shaped capture-profile lug. The system includes a clasp securable to machinery designed to lift/move the clasp, the lug, and any lug-attached structure. The clasp is configured to reversibly secure the lug with a lever-driven blocking mechanism. The clasp defines a receiving area, which may described as a canal, which has an open, receiving end and a closed end, sized to correspond to a diameter of the lug. The receiving area may be formed at least in part by a shelf, which fits in a neck portion of the lug, such that once the lug is inserted into the receiving area, the shelf holds the lug in the receiving area, at the end opposite the receiving end. The shelf may be recessed so that the lug can gravity-seat into a recessed section of the shelf and cannot move in the direction of the open end of the receiving area. The clasp also may include a lifting machinery-attachable lever, with two ends. The lever may rotate about an axis parallel to a receiving direction defined by the receiving area. The radius of the end of the lever may be large enough to block reverse movement of the lug out of the receiving area, after the lug is secured in the gravity-seated position. The lever may rotate such that the lug is not blocked for removal from the receiving area.

The present disclosure further provides a lockable, releasable mechanical picking system for use with a lug attached to an article to be picked and maneuvered. The system may include a lug-receiving structure having a lug-receiving void space, and a relatively moveable gate structure, operable within the void space to establish locked and unlocked conditions relative to the mentioned void space for permitting, selectively, free ingress and egress of a lug relative to the void space in the unlocked condition, and positive capture of a received lug in the locked condition.

The disclosure set forth above may encompass multiple distinct inventions with independent utility. Although each of these inventions has been disclosed in its preferred form(s), the specific embodiments thereof as disclosed and illustrated herein are not to be considered in a limiting sense, because numerous variations are possible. The subject matter of the inventions includes all novel and nonobvious combinations and subcombinations of the various elements, features, functions, and/or properties disclosed herein. The following claims particularly point out certain combinations and subcombinations regarded as novel and nonobvious. Inventions embodied in other combinations and subcombinations of features, functions, elements, and/or properties may be claimed in applications claiming priority from this or a related application. Such claims, whether directed to a different invention or to the same invention, and whether broader, narrower, equal, or different in scope to the original claims, also are regarded as included within the subject matter of the inventions of the present disclosure. Further, ordinal indicators, such as first, second, or third, for identified elements are used to distinguish between the elements, and do not indicate a particular position or order of such elements, unless otherwise specifically stated.

We claim:

1. A system for mechanically moving components with lifting machinery, comprising:

a component;

a lug mounted to the component and defining a central axis that extends through the component; and a clasp connectable to the lifting machinery and including a body configured to receive the lug by transverse motion of the lug and the body relative to one another in a direction transverse to the central axis such that axial removal of the received lug from the body parallel to the central axis is prevented, the clasp also including a gate that is configured to pivot as a unit with respect to the body and the received lug between (a) a lug-releasing position that allows removal of the received lug from the body transverse to the central axis and (b) a lug-capturing position in which the gate directly obstructs removal of the received lug from the body transverse to the central axis.

2. The system of claim 1, further comprising lifting machinery connected to the body of the clasp via the gate.

3. The system of claim 1, wherein the gate is configured to remain in a lug-capturing position while the gate is under tension and to pivot to a lug-releasing position when the tension is released.

4. The system of claim 1, wherein the gate is configured to remain in a lug-capturing position while the gate pivots at least about 90 degrees with respect to the body.

5. The system of claim 1, wherein the gate has a pair of lug-releasing positions that are rotationally separated from one another by a lug-capturing position.

6. The system of claim 1, wherein the gate is elongated to define a long axis and is configured to remain in an orientation in which the long axis is vertical while the component is lifted, and to pivot away from a vertical orientation when tension on the gate is released.

7. The system of claim 1, wherein the component defines a receiver to receive a copy of the lug.

8. A method of mechanically moving a component via a lug mounted to the component, the lug defining a central axis, the method comprising:

mating the lug and a clasp with one another transversely to the central axis such that the lug is received by a body of the clasp and such that the body prevents removal of the received lug parallel to the central axis, wherein the clasp includes a gate that is pivotally connected to the body;

applying upward force on the gate with lifting machinery such that the gate pivots as a unit with respect to the body and the received lug to a lug-capturing position in which the gate directly obstructs removal of the received lug from the body transverse to the central axis and such that the component is lifted while the gate supports the body and remains in the lug-capturing position; and releasing tension on the gate such that the gate pivots to a lug-releasing position that allows removal of the lug from the clasp transverse to the central axis.

9. The method of claim 8, wherein the step of mating is performed while the component is arranged in an at least generally horizontal orientation, and wherein the step of applying upward force includes a step of lifting the component from the at least generally horizontal orientation to an at least generally vertical orientation.

10. The method of claim 8, wherein the gate rotates at least about one-quarter turn during the step of applying upward force.

11. The method of claim 8, further comprising a step of applying a horizontal force to the clasp after the step of releasing tension to remove the lug from the clasp.

12. The method of claim 8, wherein the component is a column.

13. A system for mechanically moving components, comprising:

a lug defining a central axis; and a clasp including a body pivotally connected to a gate, the clasp being configured to receive the lug by movement of the body and the lug relative to one another transverse to the central axis while the gate remains in an open position, such that removal of the received lug from the body parallel to the central axis is prevented and removal of the received lug from the body transverse to the central axis is permitted, the gate being configured to pivot as a unit with respect to the body and the received lug, from the open position to a closed position in which the gate directly obstructs removal of the received lug from the body transverse to the central axis;

wherein the body is configured to be connected to lifting machinery via the gate, such that the gate supports the body when the clasp is lifted by lifting machinery.

14. The system of claim 13, wherein the gate is configured to pivot from the open position to the closed position in response to upward force applied by the lifting machinery.

15. The system of claim 14, wherein the gate pivots about a pivot axis, wherein a region of the gate having a smaller radius is aligned with the received lug in the open position, wherein a region of the gate having a larger radius is aligned with the received lug in the closed position and directly obstructs removal of the received lug from the clasp.

16. The system of claim 13, wherein the received lug has a smaller range of axial travel, if any, parallel to the central axis in the closed position relative to the open position.

17. The system of claim 13, wherein the gate has a pair of closed positions that are rotationally offset from one another by at least about 90 degrees.

18. The system of claim 13, wherein the gate has a pair of open positions that are rotationally separated from one another by at least one closed position of the gate.

19. The system of claim 13, wherein the lug is mounted to a component that includes a receiver corresponding to and positioned opposite the lug on the central axis.

20. The method of claim 13, wherein the lug is mounted to a column.

* * * * *